US009427023B2

(12) United States Patent
Liu

(10) Patent No.: US 9,427,023 B2
(45) **Date of Patent: *Aug. 30, 2016**

(54) ELECTRONIC CIGARETTE AND ELECTRONIC CIGARETTE DEVICE

(75) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 633 days.

This patent is subject to a terminal disclaimer.

(21) Appl. No.: 13/807,733

(22) PCT Filed: Jun. 20, 2012

(86) PCT No.: PCT/CN2012/077235

§ 371 (c)(1),
(2), (4) Date: Dec. 29, 2012

(87) PCT Pub. No.: WO2013/189048

PCT Pub. Date: Dec. 27, 2013

(65) Prior Publication Data

US 2013/0340779 A1 Dec. 26, 2013

(51) Int. Cl.
*A24F 47/00* (2006.01)

(52) U.S. Cl.
CPC ..... *A24F 47/008* (2013.01); *A24F 47/002* (2013.01)

(58) Field of Classification Search
CPC .. A61M 15/06; A24F 47/008; A24F 47/004; A24F 47/002
USPC ..... 131/270, 273, 194; 128/202.21
See application file for complete search history.

(56) References Cited

U.S. PATENT DOCUMENTS 4,579,128 A * 4/1986 Ball ..... 131/201
6,216,705 B1 * 4/2001 Ossepian ..... 131/273

(Continued)

FOREIGN PATENT DOCUMENTS

CN 100593982 * 3/2010 ..... A24F 47/00
CN 101720980 * 6/2010 ..... A24D 3/06
CN 201830900 * 5/2011 ..... A24F 47/008

(Continued)

OTHER PUBLICATIONS

JP 3160951 (Abstract Translation) [online], [retrieved on Feb. 20, 2015], retrieved from Thomson Reuters.*
FR2909527 (Machine Translation) [online], [retrieved on Oct. 3, 2015], retrieved from Espacenet (http://worldwide.espacenet.com/?locale=en_EP).*
CN100593982 (Machine Translation) [online], [retrieved on Oct. 3, 2015], retrieved from Google Patents (https://patents.google.com/).*

(Continued)

*Primary Examiner* — Michael H Wilson
*Assistant Examiner* — Yana B Krinker
(74) *Attorney, Agent, or Firm* — Cheng-Ju Chiang

(57) ABSTRACT

This invention relates to an electronic cigarette and an electronic cigarette device, the electronic cigarette includes a sucking cylinder, a sucking nozzle configured at an end of the sucking cylinder; wherein the sucking cylinder and/or the sucking nozzle are processed with wooden material; wherein the wooden material is natural timber. The electronic cigarette device includes the above-mentioned electronic cigarette, and further includes an electronic cigarette casing, for accommodating and charging the electronic cigarette; the electronic cigarette casing includes a bottom box and a box cover, the bottom box and/or the box cover are made of the wooden material. The electronic cigarette and the electronic cigarette casing are of health, hygiene, environmental protection and good taste and good feel.

13 Claims, 8 Drawing Sheets

(56) References Cited

U.S. PATENT DOCUMENTS

| | | | | |
|---|---|---|---|---|
| 2011/0011396 | A1* | 1/2011 | Fang | 128/202.21 |
| 2011/0303231 | A1* | 12/2011 | Li et al. | 131/329 |

FOREIGN PATENT DOCUMENTS

| | | | | |
|---|---|---|---|---|
| FR | 2909527 | * | 6/2008 | A24F 47/002 |
| JP | 3160951 | * | 3/2010 | A24F 15/00 |

OTHER PUBLICATIONS

CN101720980 (Machine Translation) [online], [retrieved on Oct. 3, 2015], retrieved from Google Patents (https://patents.google.com/).*

CN201830900 (Machine Translation) [online], [retrieved on Oct. 3, 2015], retrieved from Google Patents (https://patents.google.com/).*

* cited by examiner

ELECTRONIC CIGARETTE AND ELECTRONIC CIGARETTE DEVICE

CROSS REFERENCE TO RELATED APPLICATIONS

The present application is a 35 U.S.C. §371 National Phase conversion of International (PCT) Patent Application No. PCT/CN2012/077235, filed on Jun. 20, 2012, the disclosure of which is incorporated by reference herein. The PCT International Patent Application was filed in Chinese.

TECHNICAL FIELD

This invention relates to a field of electronic cigarettes, and particularly to an electronic cigarette device comprising an electronic cigarette and an electronic cigarette casing.

DESCRIPTION OF BACKGROUND

Current electronic cigarettes and electronic cigarette casings are made of plastic or metallic materials, the electronic cigarettes generally comprise a sucking rod and a power rod, while the sucking rod comprises: a sucking cylinder, a sucking nozzle, a liquid smoke cup for reserving liquid smoke, and an atomizing device fixed in the sucking cylinder, the atomizing device comprises an atomizer and an atomizing cup separately configured for accommodating the atomizer and so on; the sucking nozzle, the sucking cylinder and so on are made of plastic or metallic materials.

The current electronic cigarettes have the following shortcomings: the sucking nozzle and the casing made of plastic have peculiar smell, environmental pollution, poor taste, and harm to human health; the atomizing device having the separately configured atomizing cup has a complex inner structure and high cost of production. The electronic cigarette also has the problems of environmental pollution, poor taste etc.

SUMMARY

An object of the present invention is: to provide an electronic cigarette which has a wooden sucking nozzle and/or a wooden sucking cylinder, which is better for health, hygiene and environmental protection, and has a good taste and a good feel; and the atomizer in the electronic cigarette is simple in structure, easy to manufacture, and can save in the cost of production.

To achieve the above object, the present invention provides an electronic cigarette, comprising a sucking cylinder, a sucking nozzle configured at an end of the sucking cylinder; wherein the sucking nozzle and/or the sucking cylinder are processed with wooden material.

Furthermore, the wooden material is natural timber; and the natural timber comprises one or more kinds of pine wood, mahogany, yellow rosewood, red sandalwood, rosewood, wenge, oak, walnut, maple, birch, cherrywood, hickories, camphor; processing technologies comprise wood cutting, wood forming processing, wood surface decoration and disinfection.

Furthermore, the sucking nozzle defines a through venthole therein, which comprises a hemispherical end suitable for users' mouth.

Furthermore, the sucking nozzle further comprises a plug end matched with an inner wall of the sucking cylinder and inserted into an end of the sucking cylinder.

Furthermore, the electronic cigarette further comprises a liquid smoke cup and an atomizer which are located within the sucking cylinder; the liquid smoke cup comprises a cup holder and a lid which are opposite to each other and spaced from each other by a certain distance and engaged with an inner wall of the sucking cylinder by expansion, and a conduit and a liquid storage component which are fixed between the cup holder and the lid, the liquid storage component is sleeved around the conduit; the conduit has opened opposite ends and a hollow inside, the atomizer is hold on the conduit.

Furthermore, the atomizer comprises a heating wire and a fiber element for supporting the heating wire and absorbing liquid smoke, the conduit forms a locking slot radially extended through a sidewall of the conduit for maintaining the fiber element, the fiber element is fixed in the locking slot and opposite ends of the fiber element abut against the liquid storage component to absorb the liquid smoke for being atomized by the heating wire.

Furthermore, the cup holder and the lid both have a cylindrical cup-shaped structure, and form a positioning post, and defines an annular internal cavity, the positioning post of the lid and the positioning post of the cup holder are corresponded to each other, and respectively opposite ends of the conduit; the annular internal cavity of the lid and the annular internal cavity of the cup holder are corresponded to each other, and respectively receive opposite ends of the liquid storage component.

Furthermore, the sucking cylinder further comprises a liquid isolating seat configured at a bottom of the cup holder for preventing liquid leakage, the liquid isolating seat defines a venthole axially extended therethrough.

Furthermore, the electronic cigarette further comprises a bottom cap covering another end of the sucking cylinder; the bottom cap is made of a wooden material.

Furthermore, the electronic cigarette further comprises a batter sleeve and a battery; the battery sleeve is mounted within the sucking cylinder and fixed by the bottom cap; the battery is mounted within the battery sleeve.

Furthermore, the electronic cigarette further comprises a liquid barrier capable of absorbing and separating liquid and disposed at a top of the battery sleeve which is close to the liquid smoke cup.

Furthermore, the electronic cigarette further comprises a control module holder and a control module, the control module holder is fixed into the inner wall of the sucking cylinder and located between the bottom cap and the battery sleeve; the control module is fixed into the control module holder and electrically connected with the battery.

Furthermore, the fiber element comprises a horizontal rod and two longitudinal rods respectively connected with opposite ends of the horizontal rod to form an integral unit together with the horizontal rod, wherein the heating wire is wound on the horizontal rod, opposite ends of the heating wire correspondingly are attached on inner walls of the longitudinal rods, and projected from the liquid smoke cup to electrically connect with the battery; the two longitudinal rods of the fiber element are respectively firmly clamped between the inner wall of the liquid storage component and the outer wall of the conduit; the liquid smoke cup further defines perforations axially extended through a bottom of the cup holder for the heating wire to pass through, an engaging conjunction of the heating wire and the perforations is circumferentially sealed.

The present invention further provides an electronic cigarette device, comprising the above-mentioned electronic cigarette, and further comprising an electronic cigarette casing, adapted for accommodating and charging the electronic cigarette.

Furthermore, the electronic cigarette casing comprises a bottom box, a box cover covering the bottom box, a charging circuit unit, and a rechargeable battery; the bottom box and/or the box cover are made of wooden material.

The technical advantage of the embodiments of the present invention is that: the sucking nozzle and the sucking cylinder are made of a wooden material, which is better for health, hygiene and environmental protection, and has a good taste and a good feel.

It is not needed to separately provide an atomizing cup, the atomizer is directly fixed within the liquid smoke cup, so that electronic cigarette is simple in structure, easy to manufacture, and can save in the production cost.

The bottom box and box cover of the electronic cigarette casing are made of wooden materials, for environmental protection and good feel.

The embodiments of the present invention will be described in further detail below in conjunction with the accompanying drawings.

DETAILED DESCRIPTION OF THE EMBODIMENTS

Figure 1:
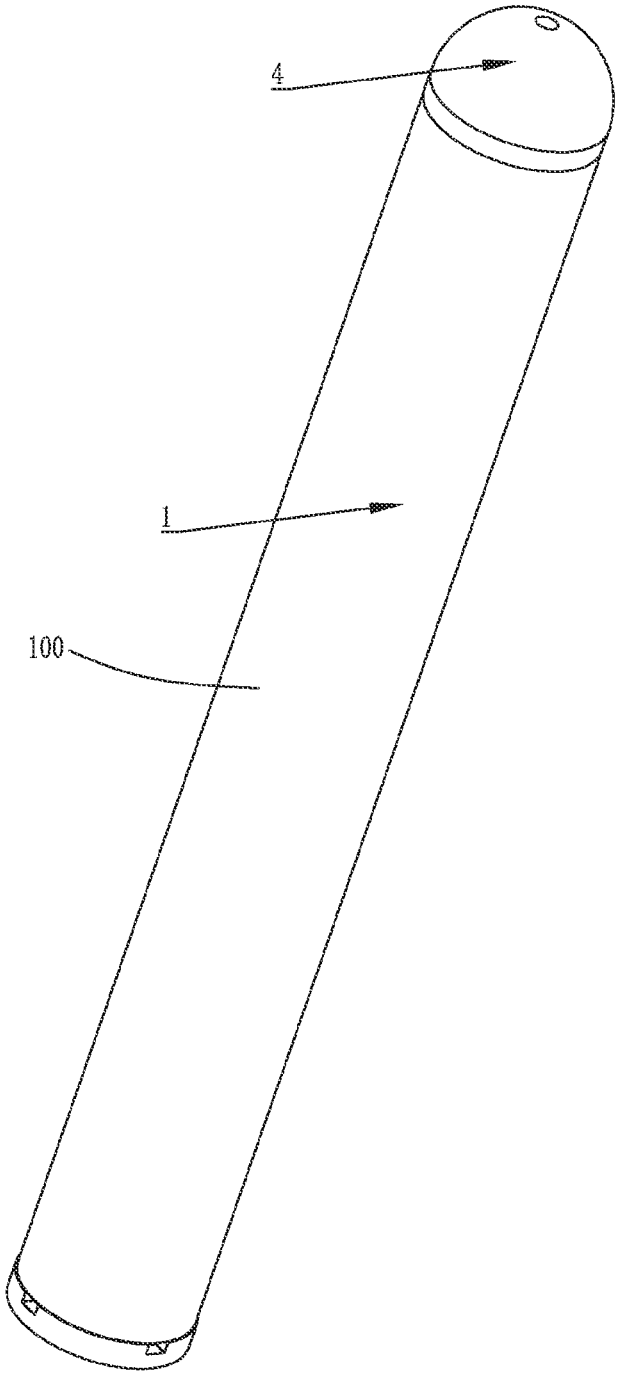
FIG. 1 is an isometric view of an electronic cigarette in accordance with an embodiment of the present invention.

As shown from FIG. 5 to FIG. 10, a wooden electronic cigarette device provided in accordance with an embodiment of the present invention comprises an electronic cigarette 100 and an electronic cigarette casing 200 for accommodating and charging the electronic cigarette 100.

As shown from FIG. 1 to FIG. 7, the electronic cigarette 100 comprises a sucking cylinder 1, an atomizer 21 for transferring liquid smoke into fogged smoke, a liquid smoke cup 3 for accommodating the liquid smoke and a sucking nozzle 4. The sucking nozzle 4 is configured at an end of the sucking cylinder 1, the atomizer 21 and the liquid smoke cup 3 are securely located within the sucking cylinder 1. Wherein at least part of the sucking nozzle 4 where it directly contacts with user is made of wooden materials, which is better for health, hygiene, environmental protection and has a good taste and a good feel. It adopts natural timber as the woden materials. The natural timber is such species including: pine, mahogany, yellow rosewood, red sandalwood, rosewood, wenge, oak, walnut, maple, birch, cherrywood, hickories, camphor and so on. Processing steps of the timber comprises: wood cutting, wood processing, wood surface decoration and disinfection etc. A processing method of the timber comprises: material drying, sawing, cutting, planing, milling, drilling, polishing, and disinfecting. Processing equipments can be conventional lathes, milling machines, drilling machines, and polishing machines.

The electronic cigarette 100 can have its whole shell such as the sucking cylinder 1, made of wooden materials, the materials and the processing method can be referenced with the above-description.

Figure 2:
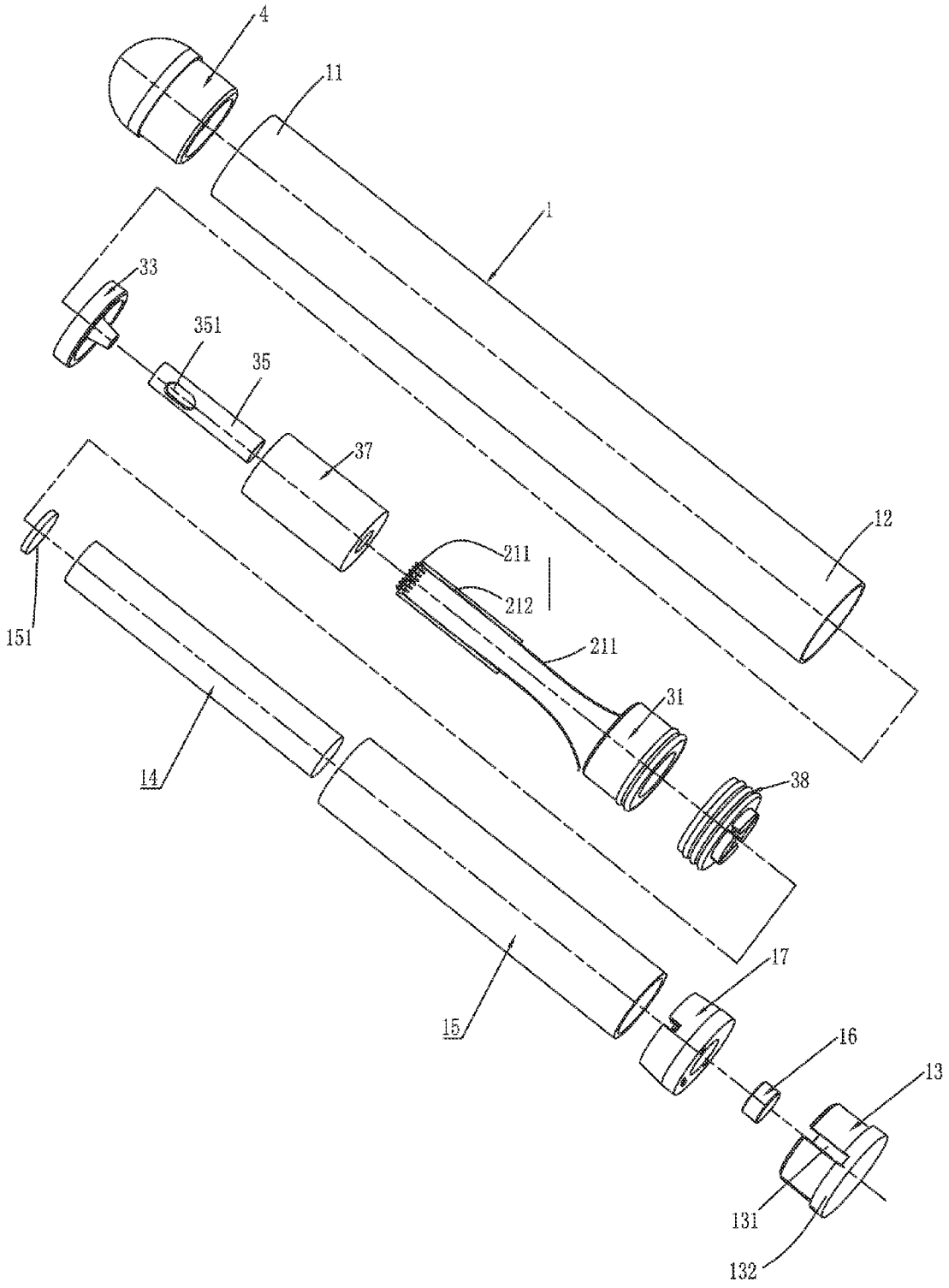
FIG. 2 is an exploded view of an electronic cigarette in accordance with an embodiment of the present invention.
Figure 3:
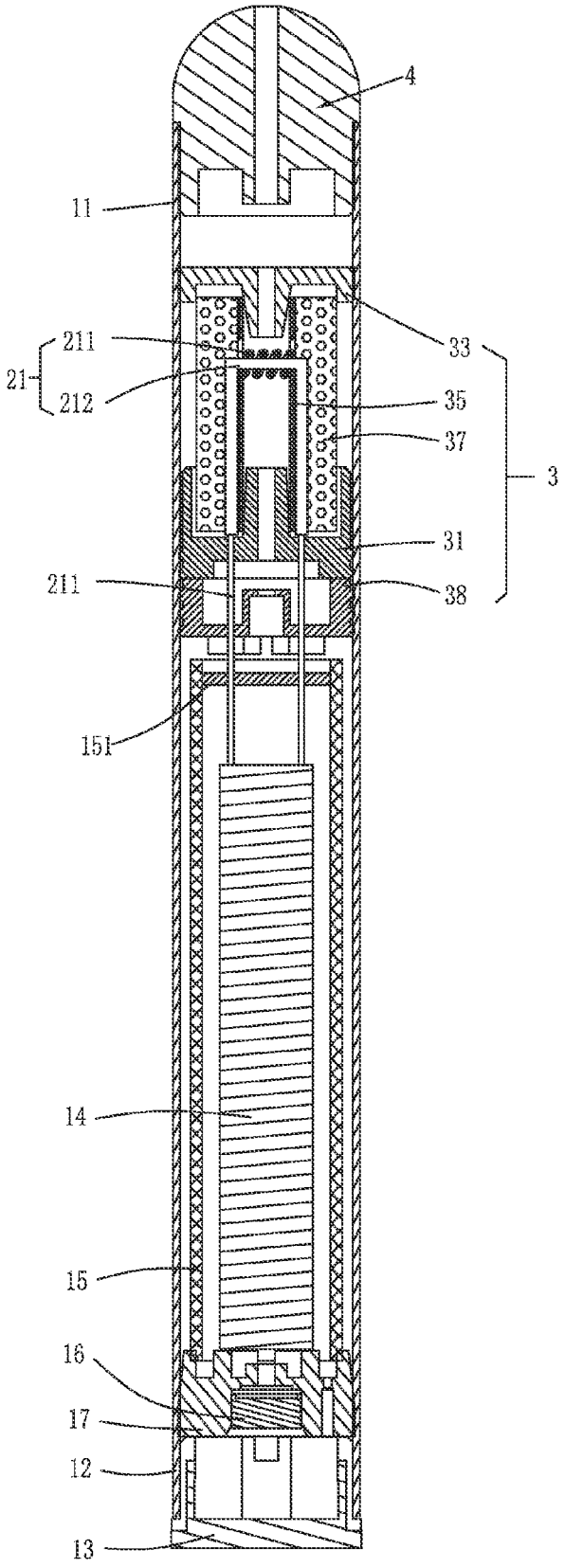
FIG. 3 is a cross-sectional view of an electronic cigarette in accordance with an embodiment of the present invention.
Figure 4:
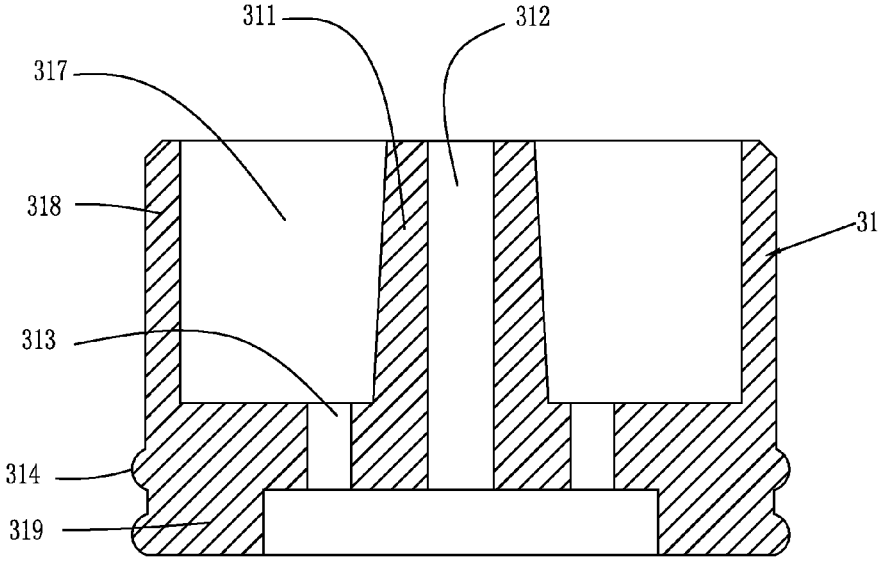
FIG. 4 is a cross-sectional view of a cup holder of a liquid smoke cup in accordance with an embodiment of the present invention.
Figure 5:
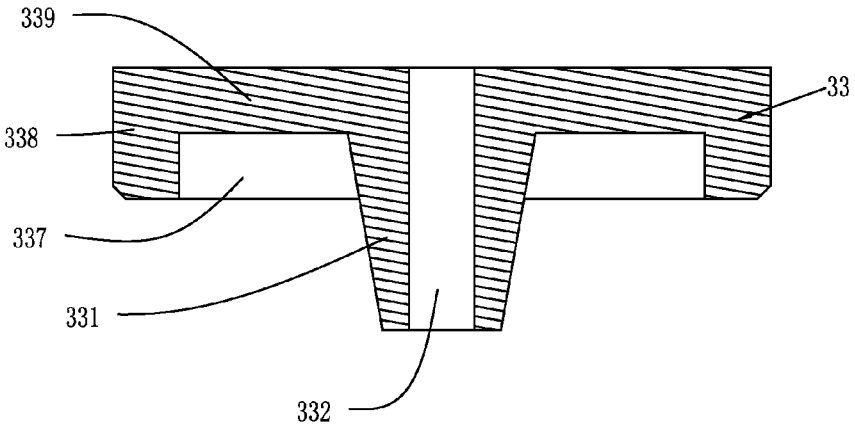
FIG. 5 is a cross-sectional view of a lid of a liquid smoke cup in accordance with an embodiment of the present invention.
Figure 6:
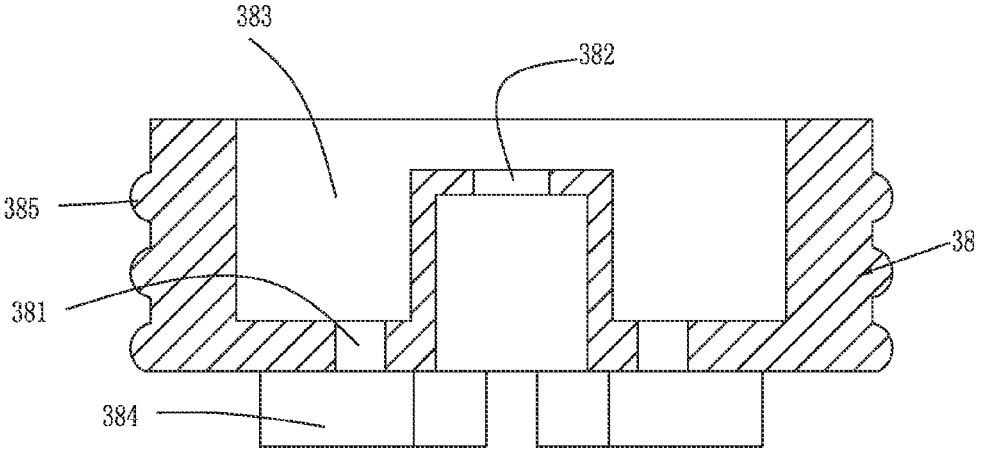
FIG. 6 is a cross-sectional view of a liquid isolating seat of a liquid smoke cup in accordance with an embodiment of the present invention.
Figure 7:
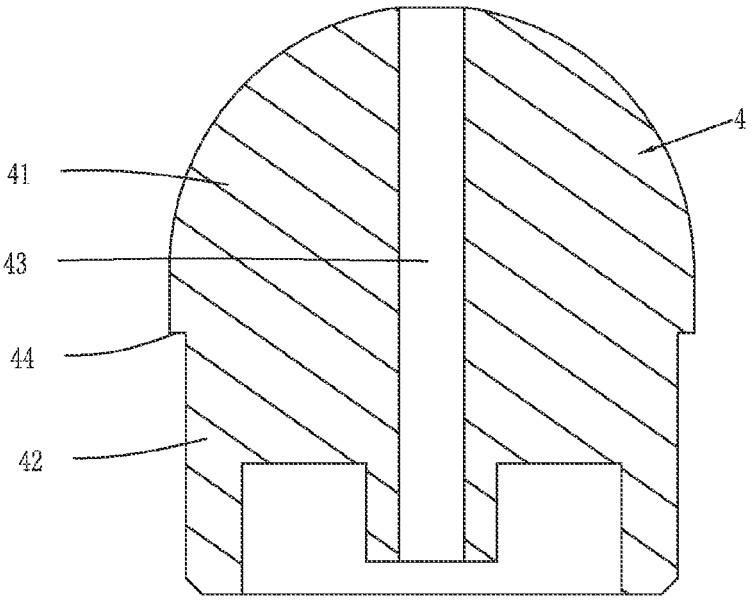
FIG. 7 is a cross-sectional view of a sucking nozzle of a liquid smoke cup in accordance with an embodiment of the present invention.

As shown in FIG. 2 and FIG. 3, the sucking cylinder 1 has a hollow, elongated and cylindrical structure. In the embodiment, it is substantially a cylindrical shell, of course, the sucking cylinder 1 can also be a sleeve with a predetermined taper or in other shapes. The sucking cylinder 1 is made of plastic material, the sucking cylinder 1 can be designed to be wholly transparent or at least partially transparent, the location to install the liquid smoke cup 3 is transparent or the location to install the liquid smoke cup 3 is provided with an observation window to easily observe the liquid smoke volume in the liquid smoke cup 3. The sucking cylinder 1 is opened at both opposite ends thereof, comprises a top portion 11 connected with the sucking nozzle 4 and a bottom portion 12 opposite to the top portion 11, the bottom portion 12 is provided with a bottom cap 13, a battery 14, a battery sleeve 15, a control module 16 for controlling the atomizer 21 to work and a control module holder 17. The bottom cap 13 is cylindrical, and is defined with an air intake 131 in its side wall along an axial direction thereof, so that air can enter the sucking cylinder 1, the bottom cap 13 is provided at its bottom with a flange 132 which is radially outwardly extended and matched with the sucking cylinder 1 for positioning. The battery 14 is positioned into the battery sleeve 15, the control module 16 is electrically connected with electrodes of the battery 14 and the atomizer 21 respectively, and is provided with a miniature pneumatic switch to switch on the control circuit and start the atomizer 21 to work; the control module holder 17 is defined with a receiving slot for accommodating the control module 16 and an axially penetrating venthole therein, the control module 17 is engaged with a bottom of the battery sleeve 15 by plugging to position the battery sleeve 15 into the sucking cylinder 1.

As shown in FIG. 2 and FIG. 3, the atomizer 21 is adapted for transferring the liquid smoke into fogged smoke, and comprises a heating wire 211 and a fiber element 212 for absorbing the liquid smoke and supporting the heating wire 211, and the heating wire 211 is wound on the fiber element 212. In the embodiment, the fiber element 212 is received and fixed within the liquid smoke cup 3, and comprises a horizontal rod and two longitudinal rods integrally connected with opposite ends of the horizontal rod, length of the longitudinal rods is capable of being appropriately adjusted according to the height of the liquid storage component 37, the fiber element 212 is wholly disposed within the liquid smoke cup 3; the heating wire 211 is wound on the horizontal rod of the fiber element 212, the heating wire 211 has its opposite ends correspondingly attached on inner walls of the longitudinal rods of the fiber element 212 and projected from the liquid smoke cup 3 into the battery sleeve 15 to electrically connect with the positive electrode and negative electrode of the battery 14. The fiber element 212 is capable of absorbing water and reserving water like a sponge, and can be made of a material having a liquid-absorbent and fluid barrier properties, such as a cotton material.

As shown in FIG. 2 and FIG. 3, the liquid smoke cup 3 comprises a cup holder 31, a lid 33, a conduit 35, a liquid storage component 37 and a liquid isolating seat 38. Wherein, the cup holder 31 and the lid 33 are fixed on the inner wall of the sucking cylinder 1 opposite to each other and spaced from each other in a certain distance; the conduit 35 is fixed between the cup holder 31 and the lid 33; the liquid storage component 37 is fixed at an exterior of the conduit and disposed between the cup holder 31 and the lid 33. The liquid isolating seat 38 is disposed at a side of the cup holder 31 opposite to the lid 33, abuts against the cup holder 31 and is secured to the inner wall of the sucking cylinder 1 by expansion.

In the embodiment, the cup holder 31 (see FIG. 4) is a cylindrical cup, comprises an annular sidewall 318, a round cup bottom 319, and a positioning post 311 axially extended from a central portion of the cup bottom 319. Wherein the annular sidewall 318 and the positioning post 311 define an annular internal cavity 317 therebetween; a cup holder venthole 312 is axially extended through the positioning post 311 and the cup bottom 319; the cup bottom 319 is provided with two perforations 313 for the heating wire 211 to pass through. An external of the sidewall 318 is provided with expanding rings 314 for engaging with the sucking cylinder 1 by expansion, the cup holder 31 is secured to the inner wall of the sucking cylinder 1 by expansion utilizing the sidewall 318 and the expanding rings 314.

The lid 33 (see FIG. 5) can be made of plastic material, and its shape and size are matched with the inner wall of the sucking cylinder 1. In the embodiment, it is a cylindrical cover, and comprises an external annular sidewall 338, a top wall 339, and a positioning post 331 axially extended from a central portion of the top wall 339. The positioning post 331 and the sidewall 338 together define an annular internal cavity 337. A lid venthole 332 axially extends through the positioning post 331 and the top wall 339. The lid 33 has its external diameter slightly bigger than an inner diameter of the sucking cylinder 1, and the lid 33 is secured to the inner wall of the sucking cylinder 1 by expansion via the sidewall 338. When the liquid smoke in the liquid smoke cup 3 runs out, pull out the sucking nozzle 4, and then pull out the lid 33, add liquid smoke into the liquid smoke cup 3. The positioning post 331 of the lid 33 and the positioning post 311 of the cup holder 31 correspond to each other, and respectively fix the opposite ends of the conduit 35. The annular internal cavity 337 of the lid 33 and the annular internal cavity 317 of the cup holder correspond to each other, and respectively receive the opposite ends of the liquid storage component 37.

The conduit 35 (see FIG. 2, FIG. 3) is used for supporting the liquid storage component 37, and simultaneously for restraining a height of the liquid smoke cup 3 and supporting the fiber element 212, and further leads the smoke generated by the atomizer 21 atomizing the liquid smoke to an exterior of the sucking cylinder 1. In the embodiment, the conduit 35 is a hollow pipe, and can be made of plastic or a fiber material, such as a fiberglass tube, and comprises a top portion and a bottom portion, the top portion thereof is sleeved around the positioning post 331 of the lid 33 and circumferentially hermetically engaged with it, and the bottom portion is sleeved around the positioning post 311 of the cup holder 31 and circumferentially hermetically engaged with it. The conduit 35 forms a locking slot 351 radially extended through the sidewall of the conduit 35, for supporting and fixing the fiber element 212, the fiber element 212 is mounted into the locking slot 351 and abuts against the liquid storage component 37 to absorb the liquid smoke for being atomized by the heating wire 211.

The liquid storage component 37 (see FIG. 2 and FIG. 3) is used for absorbing and storing the liquid smoke injected into the liquid smoke cup 3 for a subsequent atomization by the atomizer 21, which can absorb water and reserve water like a sponge, and can be made of a material capable of absorbing and isolating liquid, such as a cotton material. The liquid storage component 37 has a hollow tube structure, which is sleeved around an outer wall of the conduit 35 and supported by the outer wall of the conduit 35 with mutual expansion thereof, and its opposite ends are respectively inserted into the annular cavity 317 of the cup holder 31 and the annular cavity 337 of the lid 33, and maintained between sidewalls which enclose the annular cavities. The liquid storage component 37 has its sidewall to abut against the fiber element 212, in the embodiment, the two longitudinal rods of the fiber element 212 are firmly clamped between the inner wall of the liquid storage component 37 and the outer wall of the conduit 35, the liquid smoke penetrates into the fiber element 212 from the liquid storage component 37 and is absorbed by the fiber element 212 to be vaporized into smoke by the heating wire 211.

The liquid isolating seat 38 (see FIG. 6) is used for preventing the liquid smoke in the atomizer 2 liquid smoke cup 3 from flowing into the battery sleeve 15. The liquid isolating seat 38 has a cylindrical cup-shaped structure, which is made of a silicone material. Its open end abuts against the cup holder 31, its bottom wall defines plug holes 381 for the heating wire 211 to extend through, the heating wire 211 extends through the perforations 313 and extends out of the plug holes 381 and is mutually engaged with inner walls of the plug holes 381 by expansion, the heating wire 211 is mutually engaged with the inner walls of the perforations 313 and the plug holes 381 by expansion, and the engaging conjunction is circumferentially sealed to avoid a leakage of the liquid smoke; the liquid isolating seat 38 defines a venthole 382 axially extended through a central portion thereof, the oil isolating seat 38 internally defines an inner chamber 383; the liquid isolating seat 38 forms an annular convex platform 384 axially outwardly extended from its bottom, in order to engage with a top of the battery sleeve 15 by plugging to position the battery sleeve 15. The oil isolating seat 38 forms expanding rings 385 on its sidewall for engaging with the sucking cylinder by expansion. Between the liquid isolating seat 38 and the battery sleeve 15 is provided with a liquid barrier 151, which is sleeved by a top of the battery sleeve 15, and is made of a material capable of absorbing and isolating liquid, such as a cotton material, for further preventing even a small amount of leakage liquid into the battery sleeve 15. In the embodiment, the heating wire 211 has its opposite ends respectively extending through the cup holder 31, the liquid isolating seat 38 and the liquid barrier 151, and then electrically connected with the electrodes of the battery 14, the liquid barrier 151 is engaged with the heating wire 211 and the battery sleeve 15 by expansion to prevent the liquid smoke to go into the battery sleeve 15. In the embodiment, the smoke passage in the liquid smoke cup 3 is jointly limited by the cup holder venthole 312 of the cup holder 31, a through hole in the conduit 35 and together with the lid venthole 332 of the lid 33.

Figure 9:
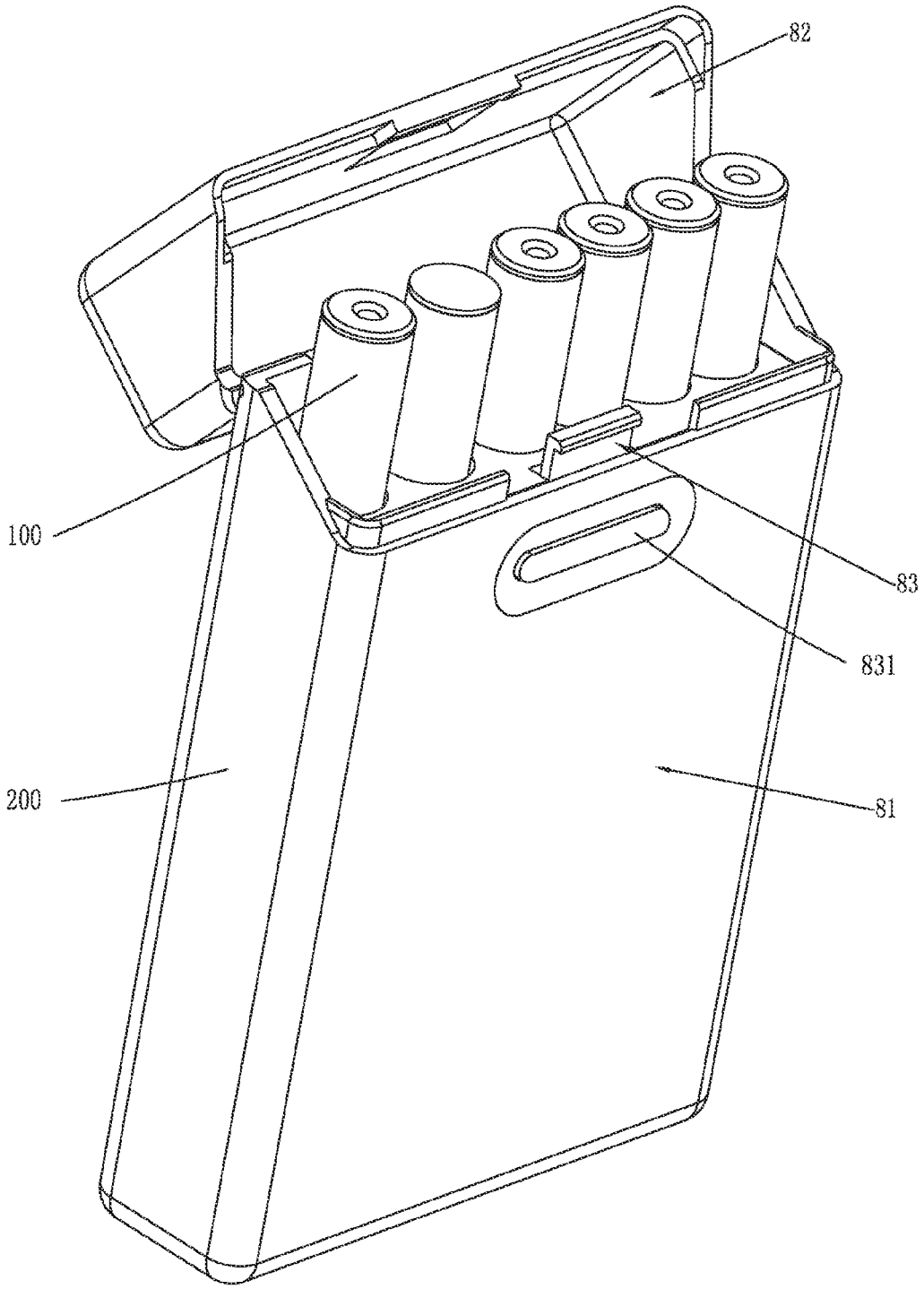
FIG. 9 is an isometric view of an electronic cigarette casing in accordance with an embodiment of the present invention.
Figure 10:
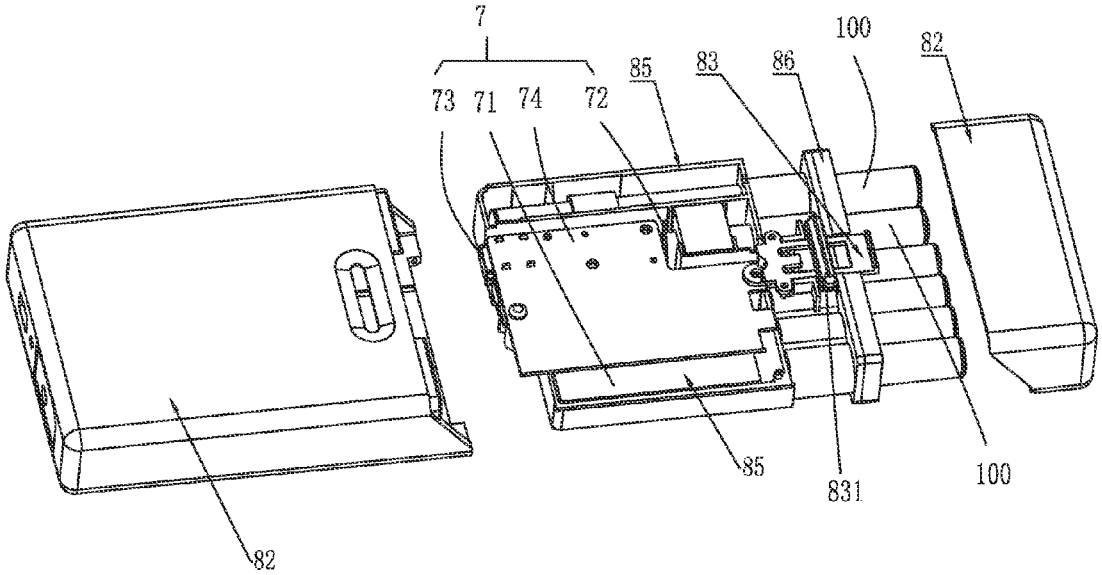
FIG. 10 is an exploded view of an electronic cigarette casing in accordance with an embodiment of the present invention.

The sucking nozzle 4 (see FIG. 7) comprises a sucking end 41 and a plug end 42 matched with the top portion 11 of the sucking cylinder 1. The sucking nozzle 4 defines a venthole 43 axially extending therethrough. In the embodiment, the sucking end 41 hemispherical, it comprises a cylindrical section located in the root thereof and a hemispherical section located at a top thereof, since the cylindrical section is short, the sucking end 41 as a whole is roughly hemisphere-shaped and has its outer diameter gradually smaller from the root to the top thereof; certainly, the sucking end 41 is not limited to this shape, for example, it can also have a shape of a circular column with uniform outer diameter(As shown in FIGS. 9 and 10). The plug end 42 is cylindrical, the plug end 42 has an outer diameter smaller than the maximum outer diameter of the sucking end 41 and slightly larger than an inner diameter of the top portion 11 of the sucking cylinder 1, between the sucking end 41 and the plug end 42 is provided with a positioning step 44 for being positioned to the sucking cylinder 1; the plug connector 42 is inserted into the top portion of the sucking cylinder 1 and secured to the inner wall of the sucking cylinder 1 by expansion, and positioned in place through the positioning step 44.

The sucking nozzle 4 in the embodiment is made of wooden materials for a good taste, health and environmental protection. The atomizer 21 and the liquid smoke cup 3 have simple structures, and share some elements, so as for facilitating production and greatly saving manufacturing cost.

Understandably, the sucking cylinder 1 and/the battery sleeve 15 and/or the bottom cap 13 can also be made of wooden materials, therefore, the electronic cigarette has better appearance and touch feeling, and low cost, better environmental protection.

Figure 8:
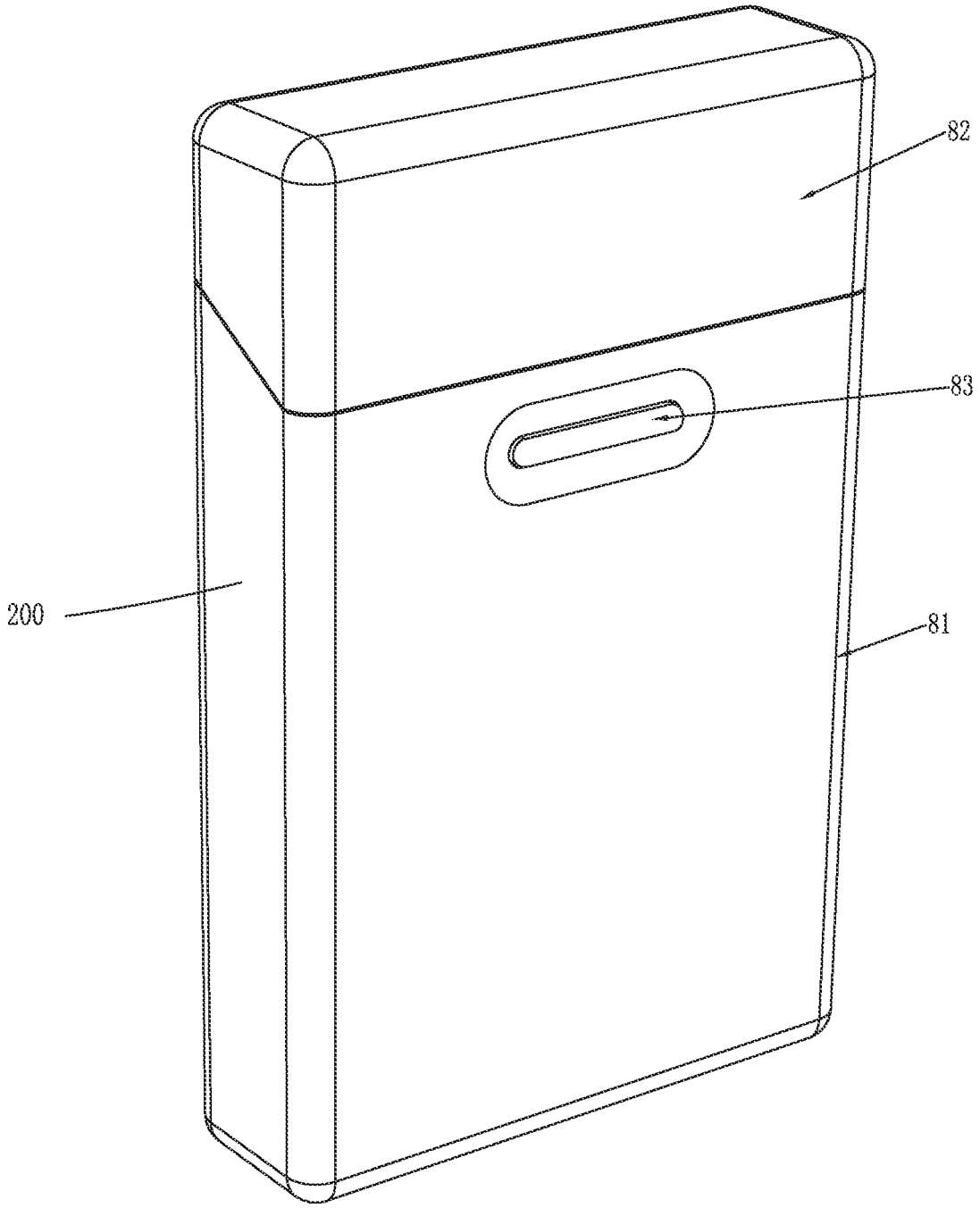
FIG. 8 is an isometric view of an electronic cigarette casing in accordance with an embodiment of the present invention.

As shown from FIG. 8 to FIG. 10, the electronic cigarette casing 200 comprises a bottom box 81, a box cover 81 matched with the bottom box 81, an on-off device 83 with a button 831 and a charging assembly 7 with a rechargeable battery 71, the rechargeable battery 71 is for charging the electronic cigarette 100.

The bottom box 81 is a hollow box, with a rectangular shape in the embodiment, and is provided with a first bracket 85 therein for accommodating and securing the rechargeable battery 71 and a second bracket 86 for supporting the electronic cigarette 100. The box cover 82 in the embodiment is pivotally mounted to the bottom box 81 through the on-off device 83, and the box cover can automatically bounce by pressing the button 831. The bottom box 81, the box cover 83 and/or the button 83 can be made of wooden materials, therefore, the electronic cigarette casing 200 has better appearance and touch feeling, and low cost, better environmental protection.

The charging assembly 7 is disposed within the box body 81, and comprises the rechargeable battery 71, a charging socket 72, a USB port 73 for connecting with external power supply by a plug and a circuit processing unit with which the rechargeable battery 71, the charging socket 72 and the USB port 73 are respectively electrically connected, in the embodiment, the charging assembly further comprises a control circuit board 74, the USB port 73 and the circuit processing unit are integrated onto the control circuit board 74, the control circuit board is fixed to the first bracket 85. The USB port 73 is used for connecting with the external power supply to charge the rechargeable battery 71.

The electronic cigarette 100 is inserted into the charging socket 72 and contacts with the positive, negative electrodes to be conducted so that the circuit processing unit on the control circuit board 74 automatically charges or powers off the electronic cigarette 100.

The above-mentioned is only the embodiments of the present invention. It should be noted, for the persons of ordinary skill in this field, improvements and modifications within the spirit of the present invention can be made, and the improvements and modifications should be seemed to be included in the claimed scope of this invention.

What is claimed is:

1. An electronic cigarette, comprising a sucking cylinder, a sucking nozzle configured at an end of the sucking cylinder, a liquid smoke cup and an atomizer which are located within the sucking cylinder; the liquid smoke cup comprising a cup holder and a lid which are opposite to each other and spaced from each other by a certain distance and engaged with an inner wall of the sucking cylinder by expansion, and a conduit and a liquid storage component which are fixed between the cup holder and lid, wherein the liquid storage component is sleeved around the conduit; the conduit has opened opposite ends and a hollow inside, the atomizer is held on the conduit; wherein the sucking cylinder and/or the sucking nozzle are processed with wooden material; the cup holder and the lid both have a cylindrical cup-shaped structure, and form a positioning post, and defines an annular internal cavity, the positioning post of the lid and the positioning post of the cup holder are corresponded to each other, and respectively opposite ends of the conduit; the annular internal cavity of the lid and the annular internal cavity of the cup holder are corresponded to each other, and respectively receive opposite ends of the liquid storage component.

2. The electronic cigarette as described in claim 1, wherein the wooden material is natural timber; the natural timber comprises one or more kinds of pine wood, mahogany, yellow rosewood, red sandalwood, rosewood, wenge, oak, walnut, maple, birch, cherrywood, hickories, camphor; processing steps comprises: cutting wood, processing wood, wood surface decoration and disinfection.

3. The electronic cigarette as described in claim 1, wherein the sucking nozzle defines a through venthole therein, and comprises a hemispherical sucking end suitable for users' mouth.

4. The electronic cigarette as described in claim 3, wherein the sucking nozzle further comprises a plug end matched with an inner wall of the sucking cylinder and inserted into the end of the sucking cylinder.

5. The electronic cigarette as described in claim 1, wherein the atomizer comprises a heating wire and a fiber element for supporting the heating wire and absorbing liquid smoke, the conduit forms a locking slot radially extended through a sidewall of the conduit for maintaining the fiber element, the fiber element is fixed in the locking slot and opposite ends of the fiber element abut against the liquid storage component to absorb the liquid smoke for being atomized by the heating wire.

6. The electronic cigarette as described in claim 5, wherein the fiber element comprises a horizontal rod and two longitudinal rods integrally connected with opposite ends of the horizontal rod, wherein the heating wire is wound on the horizontal rod, opposite ends of the heating wire correspondingly are attached on inner walls of the longitudinal rods, and projected from the liquid smoke cup to electrically connect with the battery; the two longitudinal rods of the fiber element are respectively firmly clamped between the inner wall of the liquid storage component and the outer wall of the conduit; the liquid smoke cup further defines perforations axially extended through a bottom of the cup holder for the heating wire to pass through, an engaging conjunction of the heating wire and the perforations is circumferentially sealed.

7. An electronic cigarette device, comprising an electronic cigarette as described in claim 1, and further comprising an electronic cigarette casing, adapted for accommodating and charging the electronic cigarette.

8. The electronic cigarette device as described in claim 7, wherein the electronic cigarette casing comprises a bottom box, a box cover covering the bottom box and a charging circuit unit and a rechargeable battery; the bottom box and/or the box cover are made of wooden material.

9. The electronic cigarette device as described in claim 8, wherein the wooden material is natural timber; the natural timber comprises one or more kinds of pine wood, mahogany, yellow rosewood, red sandalwood, rosewood, wenge, oak, walnut, maple, birch, cherrywood, hickories, camphor; processing steps comprises: cutting wood, processing wood, wood surface decoration and disinfection.

10. An electronic cigarette, comprising a sucking cylinder, a sucking nozzle configured at an end of the sucking cylinder, a liquid smoke cup and an atomizer which are located within the sucking cylinder; the liquid smoke cup comprising a cup holder and a lid which are opposite to each other and spaced from each other by a certain distance and engaged with an inner wall of the sucking cylinder by expansion, and a conduit and a liquid storage component which are fixed between the cup holder and lid, wherein the liquid storage component is sleeved around the conduit; the conduit has opened opposite ends and a hollow inside, the atomizer is held on the conduit;

the cup holder and the lid both have a cylindrical cup-shaped structure, and form a positioning post, and defines an annular internal cavity, the positioning post of the lid and the positioning post of the cup holder are corresponded to each other, and respectively opposite ends of the conduit the annular internal cavity of the lid and the annular internal cavity of the cup holder are corresponded to each other, and respectively receive opposite ends of the liquid storage component;

wherein the sucking cylinder and/or the sucking nozzle are processed with wooden material; the sucking cylinder further comprises a liquid isolating seat configured at a bottom of the cup holder for preventing liquid leakage, the liquid isolating seat defines a venthole axially extended therethrough.

11. An electronic cigarette, comprising a sucking cylinder, a sucking nozzle configured at an end of the sucking cylinder, a bottom cap covering another end of the sucking cylinder, a battery sleeve and a battery; wherein the sucking cylinder and/or the sucking nozzle are processed with wooden material; the bottom cap is made of wooden material; the battery sleeve is mounted within the sucking cylinder and fixed by the bottom cap; the battery is mounted within the battery sleeve;

the electronic cigarette further comprising a liquid smoke cup and an atomizer which are located within the sucking cylinder; the liquid smoke cup comprising a cup holder and a lid which are opposite to each other and spaced from each other by a certain distance and engaged with an inner wall of the sucking cylinder by expansion, and a conduit and a liquid storage component which are fixed between the cup holder and the lid, the liquid storage component being sleeved around the conduit; the conduit having opened opposite ends and a hollow inside, the atomizer being hold on the conduit; and the cup holder and the lid both have a cylindrical cup-shaped structure, and form a positioning post, and defines an annular internal cavity, the positioning post of the lid and the positioning post of the cup holder are corresponded to each other, and respectively opposite ends of the conduit; the annular internal cavity of the lid and the annular internal cavity of the cup holder are corresponded to each other, and respectively receive opposite ends of the liquid storage component.

12. The electronic cigarette as described in claim 11, further comprising a liquid barrier having liquid-absorbent and fluid barrier properties and disposed at a top of the battery sleeve which is close to the liquid smoke cup.

13. The electronic cigarette as described in claim 11, further comprising a control module holder and a control module, wherein the control module holder is fixed into the inner wall of the sucking cylinder and located between the bottom cap and the battery sleeve; the control module is fixed into the control module holder and electrically connected with the battery.

* * * * *